US009551524B2

(12) United States Patent
Egan et al.

(10) Patent No.: US 9,551,524 B2
(45) Date of Patent: Jan. 24, 2017

(54) LINER WITH ELECTRICAL PATHWAYS

(71) Applicant: Whirlpool Corporation, Benton Harbor, MI (US)

(72) Inventors: Martin Shawn Egan, Ballwin, MO (US); Michael E. Stagg, Evansville, IN (US)

(73) Assignee: Whirlpool Corporation, Benton Harbor, MI (US)

( * ) Notice: Subject to any disclaimer, the term of this patent is extended or adjusted under 35 U.S.C. 154(b) by 369 days.

(21) Appl. No.: 14/251,740

(22) Filed: Apr. 14, 2014

(65) Prior Publication Data

US 2014/0217878 A1 Aug. 7, 2014

Related U.S. Application Data

(62) Division of application No. 13/286,386, filed on Nov. 1, 2011, now Pat. No. 8,732,943, which is a division of application No. 11/231,570, filed on Sep. 21, 2005, now Pat. No. 8,048,510.

(51) Int. Cl.

| | |
|---|---|
| ***H05K 7/00*** | (2006.01) |
| ***F25D 23/06*** | (2006.01) |
| ***F25D 29/00*** | (2006.01) |

(52) U.S. Cl.

CPC ..... *F25D 23/065* (2013.01); *F25D 23/061* (2013.01); *F25D 23/066* (2013.01); *F25D 29/005* (2013.01); *F25D 2400/40* (2013.01); *Y10S 428/901* (2013.01); *Y10T 29/4913* (2015.01); *Y10T 29/4916* (2015.01); *Y10T 29/49117* (2015.01); *Y10T 29/49155* (2015.01); *Y10T 29/49158* (2015.01); *Y10T 29/49359* (2015.01); *Y10T 428/24802* (2015.01)

(58) Field of Classification Search

CPC .... F25D 23/061; F25D 23/065; F25D 23/066; F25D 2400/40; F25D 29/005; Y10S 428/901; Y10S 29/49117; Y10S 29/4913; Y10S 29/49155; Y10S 29/49158; Y10S 29/4916; Y10S 29/49359; Y10S 428/24802

USPC ..... 362/92, 133, 234; 29/592.1; 312/408; 62/264; 361/748, 760

See application file for complete search history.

(56) References Cited

U.S. PATENT DOCUMENTS

| | | | | |
|---|---|---|---|---|
| 4,081,898 | A | 4/1978 | Taylor, Jr. et al. | |
| 4,369,557 | A | 1/1983 | Vandebult | |
| 4,789,568 | A | 12/1988 | Matoba et al. | |
| 4,912,288 | A | 3/1990 | Atkinson et al. | |
| 5,033,291 | A | 7/1991 | Podoloff et al. | |
| 5,042,971 | A | 8/1991 | Ambrose | |
| 5,098,450 | A | 3/1992 | Patzelt et al. | |
| 5,128,526 | A | 7/1992 | Yoshida | |
| 5,220,488 | A | 6/1993 | Denes | |
| 5,250,758 | A | 10/1993 | Fjelstad et al. | |
| 5,269,154 | A * | 12/1993 | Schmidt | F25C 5/005 62/275 |
| 5,566,441 | A | 10/1996 | Marsh et al. | |
| 5,599,595 | A | 2/1997 | McGinley et al. | |
| 5,830,529 | A | 11/1998 | Ross | |

(Continued)

*Primary Examiner* — Jenny L Wagner
*Assistant Examiner* — Roseline Alicea Rivera

(57) ABSTRACT

A liner for an appliance is formed by a plastic sheet formed into a three dimensional shape corresponding to at least a portion of a compartment of the appliance. A plurality of electrically conductive ink pathways are applied on a surface of the plastic sheet, and a sealer material is applied to the plastic sheet to cover said pathways.

7 Claims, 2 Drawing Sheets

(56) References Cited

U.S. PATENT DOCUMENTS

| | | | | |
|---|---|---|---|---|
| 5,899,078 | A | 5/1999 | Mager | |
| 5,993,698 | A | 11/1999 | Frentzel et al. | |
| 6,369,369 | B2 | 4/2002 | Kochman et al. | |
| 6,451,364 | B1 * | 9/2002 | Ito | A23L 3/26 426/244 |
| 6,537,359 | B1 | 3/2003 | Spa | |
| 6,658,879 | B2 * | 12/2003 | Park | F25D 11/022 62/229 |
| 6,866,799 | B2 | 3/2005 | Orsbon et al. | |
| 2002/0157411 | A1 | 10/2002 | Ishikawa et al. | |
| 2003/0049394 | A1 | 3/2003 | Porchia et al. | |
| 2003/0071259 | A1 | 4/2003 | Yoshida | |
| 2006/0080819 | A1 * | 4/2006 | McAllister | G06K 17/00 29/403.3 |

* cited by examiner

LINER WITH ELECTRICAL PATHWAYS

CROSS-REFERENCE TO RELATED APPLICATIONS

The present application represents a divisional of U.S. patent application Ser. No. 13/286,386 entitled "Method of Forming a Liner for an Appliance" filed Nov. 1, 2011, pending, which application is a divisional of U.S. patent application Ser. No. 11/231,570 entitled "Liner with Electrical Pathways" filed Nov. 1, 2005, now U.S. Pat. No. 8,048,510.

BACKGROUND OF THE INVENTION

The present invention relates generally to an appliance liner, and to a method of manufacturing such liners.

Typically appliance components, such as refrigeration liners, contain or support electronic components that need to be supplied with electrical current. Usually a plurality of wires are used to supply the necessary electrical current to the various electronic components, which requires not only an assembly of the wires to the appliance, such as in wire harnesses, or as individual wires, but also the wires need to be individually connected to connectors or to connection points on the electronic components. Such an arrangement adds to the complexity and cost of the manufacturing process. Also, human error may cause the improper connection of individual wires during the manufacturing process.

Use of conductive ink for transmitting electrical current is known. For example, U.S. Pat. Nos. 6,369,369, 6,266,969, 5,993,698 and 5,899,078 disclose the use of resistive inks in a refrigeration appliance to selectively heat certain areas of the appliance. U.S. Pat. No. 6,451,364 discloses an electrode that may be formed of conductive ink and that may be used in a refrigerator to protect the user from electric shock.

It would be an improvement in the art if appliance liners were provided with a means of transmitting electrical current between points in the appliance without the use of individual wires for such transmission.

SUMMARY OF THE INVENTION

The present invention provides appliance liners with applied electrical pathways to transmit electrical current between points in the appliance without the use of individual wires for such transmission.

In an embodiment of the invention, a liner for a refrigeration appliance includes a plastic sheet material formed into a three dimensional shape corresponding to at least a portion of a refrigeration compartment of the appliance, a plurality of electrically conductive ink pathways are applied to a surface of the plastic sheet, and a sealer material is applied to the plastic sheet to cover the pathways.

At least one attachment hole may be formed in the plastic sheet material proximate at least one of the pathways. At least one registration mark may be applied to the plastic sheet material.

In an embodiment, the pathways are thicker where the pathways follow the surface around formed corners of the three dimensional shape plastic sheet material.

In an embodiment, the three dimensional shape has an inner surface and an outer surface, and the pathways are painted on the outer surface.

In an embodiment, the sealer is a clear coat material.

In an embodiment of the invention, a refrigeration appliance is provided which includes an outer cabinet, an inner liner, a plurality of electrically conductive ink pathways on a surface of the plastic sheet, and at least one electronic component attached to the inner liner and being electrically connected to the pathways.

In an embodiment, the liner has an outer surface facing the outer cabinet, and the pathways are on the outer surface.

In an embodiment of the invention, a method of forming an appliance liner is provided including the steps of:

- providing a flat sheet of plastic material to be used as a liner for the appliance,
- applying a plurality of electrically conductive ink pathways on the sheet,
- applying a seal coating material over the pathways, and
- thermal forming the flat sheet of plastic material into a three dimensional shape.

In an embodiment, the method includes a step of forming attachment holes in the plastic material.

In an embodiment, the method includes a step of applying a registration mark to the flat sheet of plastic material in conjunction with the step of applying the pathways on the sheet.

In an embodiment, the method includes a step of reading the registration mark with automated equipment to form an attachment hole in the plastic material.

In an embodiment, the step of applying the pathways comprises printing the pathways on the sheet.

In an embodiment, the step of applying the pathways comprises applying the pathways to the sheet in a greater thickness in an area that will become a corner of the three dimensional shape.

In an embodiment, the method includes a step of attaching an electronic component to the three dimensional shape.

In an embodiment, the step of applying the pathways comprises applying the pathways in a unique manner to conform to a particular electronic component.

These and other aspects and details of the present invention will become apparent upon a reading of the detailed description and a review of the accompanying drawings. Specific embodiments of the present invention are described herein. The present invention is not intended to be limited to only these embodiments. Changes and modifications can be made to the described embodiments and yet fall within the scope of the present invention.

DETAILED DESCRIPTION OF THE PREFERRED EMBODIMENTS

The present invention has particular utility in connection with a refrigeration appliance, although the invention may also be used with other types of appliances. In order to present a description of a preferred embodiment of the invention, a refrigeration appliance is selected as an environment for the invention, even though the invention is not limited to such an appliance.

Figure 1:
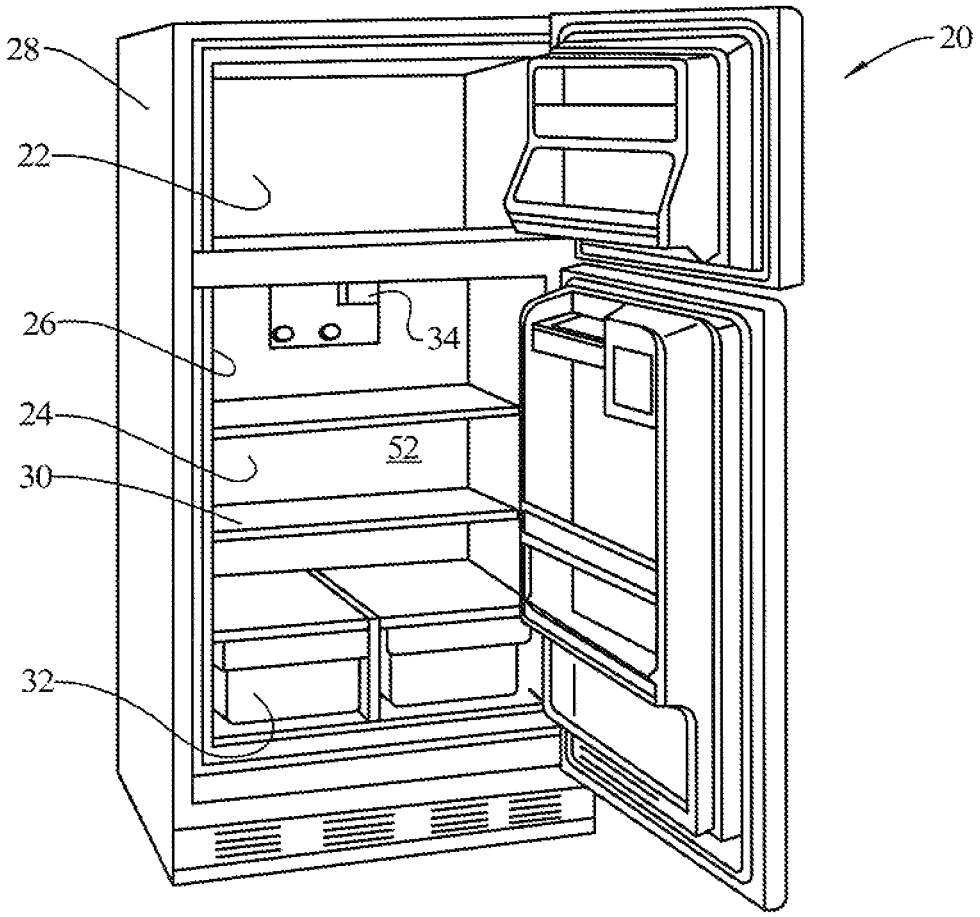
FIG. 1 is a perspective view of a refrigeration appliance embodying the principles of the present invention.

FIG. 1 illustrates a refrigeration appliance 20 having two refrigeration compartments 22, 24. The compartments are defined by a liner 26 secured inside of an outer cabinet 28 and which is shaped to form the compartments, as well as to support various shelves 30, drawers 32, and electronic components 34. The present invention provides an improvement to appliance liners, such as liners for refrigeration appliances which support or accommodate electronic components.

Figure 2:
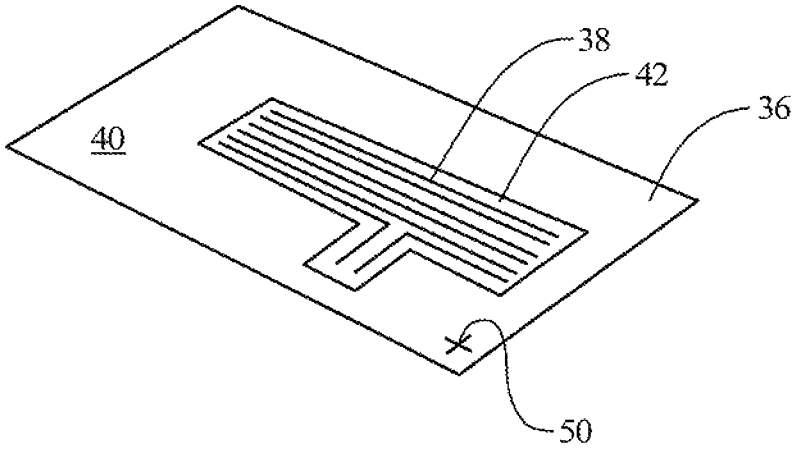
FIG. 2 is a perspective view of a plastic sheet used to form a liner for the refrigeration appliance of FIG. 1.

In an embodiment of the invention, as illustrated in FIG. 2, the liner 26 for the refrigeration appliance 20 is shown to be formed from a material in the form of a plastic sheet 36 which originally has a flat, rectangular configuration. A plurality of electrically conductive ink pathways 38 are applied to a surface 40 of the plastic sheet in a manner which is predetermined to correspond with a proper position and orientation of the pathways upon completion of the formation of the liner. The ink pathways 38 may be applied in a variety of manners, such as by printing or by spraying the ink onto the plastic sheet 36. A sealer material 42 is applied to the plastic sheet 36 to cover the pathways 38. The sealer material 42 may be applied only to the area where the pathways 38 are located, or the sealer material may be applied to a larger portion of the surface 40 of the plastic sheet 36. In an embodiment, the sealer material 42 is a clear coat material which is an electrical insulator. The sealer material 42 will protect the pathways 38 during assembly of the appliance 20 and will prevent accidental contact and electrical shorts across the pathways.

Figure 3:
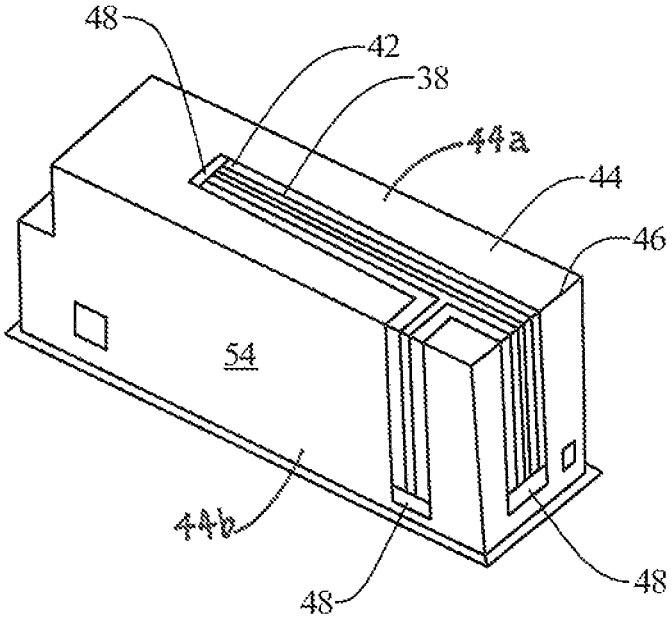
FIG. 3 is a perspective view of the plastic sheet of FIG. 2 after it has been formed into a three dimensional shape.

In order to minimize or reduce exposure to stretching, shrinkage or other negative effects, the ink pathways 38 could be placed, where possible, on surface areas that will not be subject to stretching, shrinkage or other negative effects during the subsequent manufacturing process where the sheet 36 is transformed into a three dimensional shape 44 as illustrated in FIG. 3. In an embodiment, the pathways may be applied in a thicker amount where the pathways follow the surface around formed corners 46 of the three dimensional shape 44. Such a procedure will compensate for stretching, bending and other process effects on the pathways 38 as the three dimensional shape 44 is formed.

After the ink pathways 38 have been applied, the plastic sheet 36 is subsequently formed, such as by thermal or vacuum forming, into the three dimensional shape 44 corresponding to at least a portion of the refrigeration compartments 22, 24 of the appliance 20. When this occurs, the ink pathways 38 will be positioned and oriented to direct a flow of electrical current from one specific location to a different specific location relative to the liner 26. Alternatively, the ink pathways 38 may be applied to the plastic sheet 36 after the plastic sheet has been formed into the three dimensional shape 44. In such case, concern about shrinking, stretching, etc., is alleviated and the pathways 38 may be applied in a uniform thickness, rather than thicker at the corners or other locations. In any event, in the embodiment as shown in FIG. 3, the appliance liner 26 includes the plastic sheet 36 formed into the three dimensional shape 44 having a first surface area 44*a* joined to a second, non-coplanar surface area 44*b* at the formed corner 46 and the formed sheet corresponds to at least a portion of the compartments 22, 24 of the appliance 20. The plurality of electrically conductive ink pathways 38 are applied on the first surface area 44*a* and the second surface area 44*b* and extend over the corner 46 of the plastic sheet 36. Also, the sealer material 42 is applied to the plastic sheet 36 to cover the pathways 38.

At least one attachment hole 48 may be formed in the plastic sheet material proximate at least one of the pathways 38. Preferably the attachment hole 48 is formed in the plastic sheet 36 before the sheet is formed into the three dimensional shape 44, although the attachment hole may also be formed in the sheet after the three dimensional shape is formed, and before or after the ink pathways are applied to the sheet, and before or after the sealer material 42 is applied. The attachment hole 48 is configured to correspond with an electronic component 34 that is to be attached to the liner 26 and used in conjunction with the operation of the refrigeration appliance 20. The ink pathways 38 are arranged and oriented so as to provide a correct number of pathways to the attachment hole 48 to be engaged by connection interface units on the electronic component 34 to properly supply electrical current to the electronic component. In order to assist in the formation of the attachment hole 48 at the proper position relative to the ink pathways 38, and to overcome variation in the manufacturing process, at least one registration mark 50 may be applied to the plastic sheet 36. This registration mark 50 may be applied at the same time that the pathways 38 are applied to the plastic sheet 36. The registration mark may be read with automated equipment to form the attachment hole 48 in the plastic material in the correct location.

In an embodiment, additional electrical pathways 38 can be applied on the plastic sheet 36 to allow for electronic accessories to be added to the appliance 20 during manufacturing or subsequently, such as by a user. This is possible due to the relatively low cost of the material for the electrical pathways 38 and the automated nature of applying the pathways. For example, a particular refrigeration appliance 20 may have a series of models, with different models having different electronic components 34, yet all using the same liner 26. By applying additional electrical pathways 38 to accommodate all possible components that could be attached to the appliance 20 during assembly or in the future, manufacturing flexibility is greatly enhanced in that only a single version of the liner 26 needs to be stocked to manufacture a variety of different models of the refrigeration appliance 20.

The pathways 38 could be used to join switches, power supplies and other electronic components 34 by use of contacts similar to those used in computer RAM circuit boards. Control panels could simply be pushed onto a standing material section of the liner 26 containing the correct number of pathways to achieve a solid connection. In an embodiment, the pathways 38 may be applied in a unique manner or orientation to conform to a particular electronic component 34. In this manner, the connections may be made fail-safe, in that attachment of an improper component would result in a misalignment with the electrical pathways, and no complete electrical connection would be made.

In an embodiment, the three dimensional shape 44 has an inner surface 52 (FIG. 1) and an outer surface 54 (FIG. 3), and the pathways 38 are applied on the outer surface. In a refrigeration appliance 20, this outer surface 54 will be located on the side of the liner 26 facing the outer cabinet 28 of the appliance, and hence the pathways 38 will be protected in that they will be inaccessible during normal use of the appliance. In other embodiments, the pathways 38 may be provided on the inner surface 52 or on both surfaces 52, 54.

The present invention has been described utilizing particular embodiments. As will be evident to those skilled in the art, changes and modifications may be made to the disclosed embodiments and yet fall within the scope of the present invention. For example, various components could be utilized separately or independently in some embodiments without using all of the other components in the particular described embodiment. The disclosed embodiment is provided only to illustrate aspects of the present invention and not in any way to limit the scope and coverage of the invention. The scope of the invention is therefore to be limited only by the appended claims.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The invention claimed is:

1. A refrigeration appliance comprising:

an outer cabinet, an inner liner, a plurality of electrically conductive ink pathways on a surface of the liner, at least one electronic component attached to the liner and being electrically connected to the pathways, and wherein the liner is formed into a three dimensional shape and the pathways are thicker where the pathways follow the surface around formed corners of the three dimensional shape.

2. A refrigeration appliance according to claim 1, including at least one attachment hole formed in the liner proximate at least one of the pathways.

3. A refrigeration appliance according to claim 2, wherein the electronic component is attached to the liner at the attachment hole.

4. A refrigeration appliance according to claim 2, including at least one registration mark applied to the liner.

5. A refrigeration appliance according to claim 1, wherein the liner has an outer surface facing the outer cabinet, and the pathways are on the outer surface.

6. A refrigeration appliance according to claim 1, wherein the refrigeration appliance comprises refrigeration compartments, liner has an inner surface facing the refrigeration compartments, and the pathways are on the inner surface.

7. A refrigeration appliance according to claim 1, wherein the refrigeration appliance has a plurality of models, each with a different combination of electronic components and more pathways are on the surface of the liner than are needed for the electronic components provided with a particular one of the refrigeration appliance models.

* * * * *